United States Patent [19]

Levy et al.

[11] Patent Number: 4,811,664

[45] Date of Patent: Mar. 14, 1989

[54] FUSE FOR SUB-MUNITION WARHEAD

[75] Inventors: Amir Levy, Ono; Ilan Glickman, Holon; Haim Berezniak, Rishon-Le-Zion; Avraham Rosenberg, Holon, all of Israel

[73] Assignee: The State of Israel, Ministry of Defence, Israel Military Industries, Israel

[21] Appl. No.: 173,993

[22] Filed: Mar. 28, 1988

[30] Foreign Application Priority Data

Mar. 31, 1987 [IL] Israel ..... 82066

[51] Int. Cl.[4] ..... F42C 15/04

[52] U.S. Cl. ..... 102/226; 102/227; 102/269; 102/393

[58] Field of Search ..... 102/226, 227, 228, 229, 102/230, 489, 393, 388

[56] References Cited

U.S. PATENT DOCUMENTS

| | | | |
|---|---|---|---|
| 1,751,616 | 3/1930 | Brayton | 102/226 |
| 2,131,037 | 9/1938 | Brayton | 102/227 |
| 3,119,336 | 1/1964 | Hjelm | 102/269 |
| 3,630,152 | 12/1971 | Arnell | 102/269 |
| 3,926,122 | 12/1975 | Wolterman | 102/226 |
| 3,998,164 | 12/1976 | Hadfield | 102/226 |
| 4,455,940 | 6/1984 | Furuike | 102/228 |
| 4,653,401 | 3/1987 | Gatti | 102/226 |
| 4,726,292 | 2/1988 | Gatti | 102/227 |
| 4,762,066 | 8/1988 | Rudenauer et al. | 102/226 |

*Primary Examiner*—David H. Brown

*Attorney, Agent, or Firm*—Steinberg & Raskin

[57] ABSTRACT

A slider type fuse for a cargo warhead grenade. The slider is slidable in a plane normal to the axis of the striker pin and carries additional to the detonator a pyrotechnic device comprising an igniter charge, a booster charge removed therefrom and located in close proximity to the detonator, a delay charge between the two and swingable striker means which become unlocked in the armed state and are adapted to strike the igniter charge in consequence of centrifugal forces that develop in the course of flight. The delay of the pyrotechnic device is designed to outlast the flight time of the grenade. Whenever the striker does not strike the detonator when the grenade hits the target, the detonator is initiated by the booster charge of the pyrotechnic device.

6 Claims, 6 Drawing Sheets

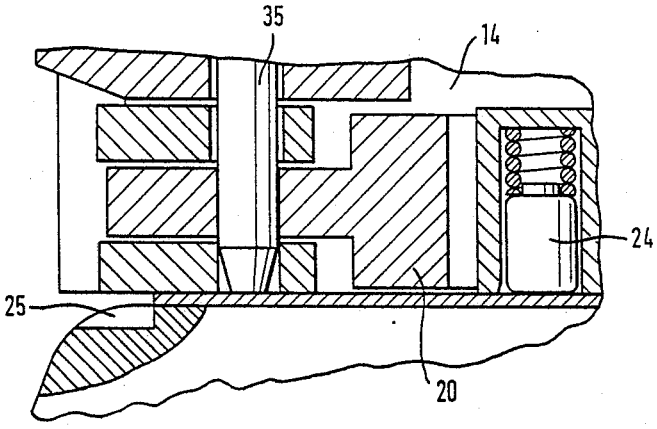
Fig. 3
Fig. 6
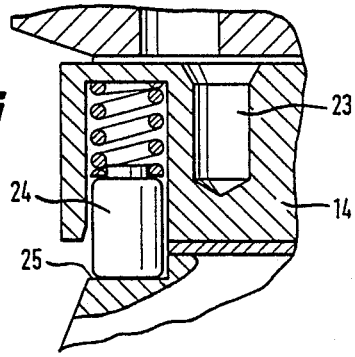

FUSE FOR SUB-MUNITION WARHEAD

BACKGROUND OF THE INVENTION AND PRIOR ART

The present invention concerns fuses for various sub-munitions to be carried in cargo projectiles such as rocket warheads, aircraft dispensers, mortar bombs, artillery shells and quite generally any type of ground or air launched warhead adapted to carry sub-munition.

In the following description and claims the term "cargo warhead" will be used for the comprehensive warhead, the term "cargo warhead grenade" will be used for the individual sub-munitions and the term "cargo projectile" will be used for the carrier of the grenades regardless of its type and the manner in which it is launched.

In cargo warheads the cargo projectile comprises means by which after launching, the individual grenades are ejected. After their ejection the grenades continue in their flight towards the target where they arrive with a statistical spread. The grenades may be optimised for specific purposes, such as anti-armour, anti-personnel or others.

The fuse of a cargo warhead grenade comprises a striker pin assembly having a striker pin movable between forward, retracted and striking positions and adapted to be locked in the forward position. When the grenades are packed into the cargo projectile, the striker pin in each fuse is unlocked but remains in the forward position until the fuse is armed. For arming, the shaft of the striker pin assembly has a portion which protrudes outside the fuse, housing and is fitted at its protruding end with drag producing means of stabilization such as, for example, a drag tape, to be referred to hereinafter occasionally as "drag producing means". When the grenade is ejected from the cargo projectile it begins to spin around its longitudinal axis and in consequence of this spin the drag producing means retract the striker pin assembly whereby the fuse is armed and the striker pin assembly remains in the retracted position until the grenade hits the target. When the grenade hits a target the inertia forces acting on the striker pin assembly drive it into the striking position with a force which, as a rule, is sufficient to detonate the fuse detonator.

In one known type of cargo warhead grenade fuses, the path of the striker pin assembly is blocked in the unarmed position and upon the release of the grenade from the cargo projectile and consequential retraction of the striker pin, the blockage is automatically removed whereupon the fuse is armed. The means for blocking the path of the striker pin in such a fuse may, for example, be in the form of a slidable member biased into a non-blocking position and locked in the blocking position by the striker pin itself. When the striker pin is retracted in consequence of the action of the drag producing means the striker pin is withdrawn from engagement with the slidable member whereupon the latter moves automatically into a non-blocking position, clearing the path of the striker pin to the detonator. In this way the fuse is armed and when the grenade hits the target the striker pin advances by force of intertia towards the detonator whereupon the latter is detonated and the grenade explodes.

Recently a new type of fuse for a cargo warhead grenade has become known. Essentially, in this type of fuse the means for blocking the striker pin assembly prior to arming are replaced by a slider that carries the detonator and is so designed that in the unarmed state of the fuse the detonator is out of alignment with the striker pin and is brought into alignment with the pin only when the fuse is armed upon retraction of the striker pin assembly by the action of the drag producing means upon ejection of the grenade from the cargo projectile. This type of cargo warhead grenade fuse will be referred to hereinafter as the slider type fuse.

The present invention is concerned with an improved slider type fuse for a cargo warhead grenade.

Basically, cargo warhead grenade fuses are impact fuses and the detonation is as a rule conditional on the grenade hitting a hard target which produces a sharp impact. Where, however, the target is soft, such as in the case of high vegetation or snow, the impact of the grenade may be insufficient to create the inertia forces required for the striker pin to travel all the way towards the detonator to detonate the latter, with the consequence that the dud rate may be unacceptably high, endangering friendly units if such will enter the impact area.

There may also be other reasons for malfunctioning of the striker pin, e.g. the presence of some sort of obstruction which impedes the movement of the striker pin with the consequence that the grenade will not explode even where it hits a hard target. Such malfunctioning may again give rise to duds liable to endanger friendly units.

It is accordingly the object of the present invention to provide an improved cargo warhead grenade fuse of the slider type comprising means for initiating the explosion of the grenade in case the normal fuse mechanism does not function.

GENERAL DESCRIPTION OF THE INVENTION

In the following description and claims the terms "axial", "radial", "vertical" and "horizontal" are used in connection with the description of fuses according to the invention. The term "axial" is meant to denote a direction which, when the fuse is mounted on a cargo warhead grenade coincides with, or is parallel to, the longitudinal axis of the grenade; the term "radial" is meant to denote the direction normal to the axial direction; the term "vertical" is meant to denote a plane or line in axial direction; and the term "horizontal" is meant to denote a plane or line normal to the vertical direction.

In accordance with the invention there is provided a slider type fuse for a cargo warhead grenade comprising a housing adapted for mounting on said grenade and accommodating a striker pin assembly having a collar and a shaft screwingly mounted therein, which shaft has an inner end portion fitted with a striker pin and an outer tail portion adapted to carry drag producing means and is capable of being unscrewed and thereby to move within said collar in axial direction from a forward, locking to a retracted, armed position, the housing further accommodating a slider holding detonator means adapted for impact ignition by said striker pin, which slider is moveable radially from a retracted position in which said detonator means are out of alignment with said striker pin to a forward position in which said detonator means are in alignment with said striker pin, said slider being locked in the retracted position by said striker pin and is unlocked when said striker pin is retracted, characterised in that said slider is moveable from the retracted to the forward, armed position by centrifugal forces resulting from the spin of the cargo warhead grenade; and further characterised by delayed action ignition means accommodated within said slider and comprising an igniter charge, a booster charge removed therefrom and located in close proximity to said detonator means and a delay charge located between the two, and swingable striker means associated with said igniter charge and mounted on the slider near an end thereof which projects out of said housing when the slider is in the forward, armed position, which swingable striker means are blocked in the retracted position and are unblocked in the forward, armed position of the slider and are capable of swinging by the action of centrifugal forces resulting from the spin of the cargo warhead grenade thereby to strike said igniter charge.

The said delayed action ignition means serve as back-up for the normal impact ignition of the detonator in case of soft landing or malfunction of the striker pin assembly. Accordingly, the delay charge will be designed for a delay time exceeding the normal flight time of the cargo warhead grenade after its ejection from the cargo projectile.

In a preferred embodiment of the invention, spring means are provided which bias the slider out of the retracted position and are adapted to initiate the radial dislocation thereof. Once this dislocation has been initiated the slider then continues to move by the action of the centrifugal forces as specified.

When a cargo warhead grenade fitted with a fuse according to the invention is ejected from a cargo projectile the drag acting on the striker shaft causes a rotation of the shaft relative to the housing with the consequence that the shaft is unscrewed and withdrawn in axial direction to reach its retracted, armed position. In consequence of the retraction of the striker pin the slider is unlocked and becomes free to move from its retracted to its forward, armed position by the action of the centrifugal forces. In the forward, armed position of the slider the detonator charge is aligned with the striker pin. Once the end portion of the slider that bears said swingable striker means associated with the igniter charge emerges out of the housing the said swingable striker means are unblocked and swing by the action of the centrifugal forces to strike the igniter charge. In consequence the delay charge is ignited and a combustion front progresses towards the booster charge with the combustion time being longer than the flight time of the grenade from the moment it is ejected from the cargo projectile until it hits the target.

In normal operation, when the grenade hits a hard target and there is no malfunctioning of the mechanism, the striker pin will strike the detonator before the combustion front in the delay charge has reached the booster charge and in consequence the grenade will detonate in a known manner. Where, however, the striker pin will not cause detonation of the detonator, be it in consequence of soft landing or of malfunctioning, the combustion progressing radially in the delay charge will eventually ignite the booster charge which in turn will initiate the detonator and cause the explosion of the grenade.

In order to ensure that the detonator means remain aligned with the striker pin once the grenade has been armed, there are preferably provided means for locking the slider in the forward, armed position. In accordance with one embodiment of the invention such means comprise a spring-biased locking pin located in the slider and a matching recess located in the body of the grenade at such a location that the recess registers with the pin in the forward, armed position of the slider. In this registering position the locking pin snaps into the recess and prevents any dislocation of the slider.

Normally, in the unarmed position of a cargo warhead grenade the slider is locked by the striker pin in the manner specified. There may however be cases of an inadvertent withdrawal of the striker pin into the retracted position in state of rest, e.g. by unintentional unscrewing of the drag producing means during handling. Where this happens and the grenade is tilted it might occur that the slider slides out of its retracted position and unless blocked would reach the forward, armed position. In order to avoid the occurance of such a hazardous situation there are preferably provided locking means that prevent a radial dislocation of the slider in a state of rest at which no centrifugal forces act on the grenade. In accordance with one embodiment such locking means comprise a spring-loaded locking member located in the housing and a recess in the slider for engagement by said locking means when the two register, said spring being so designed that during normal flight the centrifugal forces resulting from the spin of the grenade retain the locking member out of engagement with the slider. However, when no centrifugal forces are acting on the locking member, e.g. when the grenade is essentially in a state of rest and is handled for loading, the locking member snaps into the said recess by the action of said spring when the locking member and recess register in consequence of an unintentional axial dislocation of the slider.

DESCRIPTION OF THE DRAWINGS

For better understanding the invention will now be described, by way of example only, with reference to the annexed drawings in which:

FIG. 3 is a section along the lines III—III of FIG. 2;

FIG. 6 is a section along lines VI—VI of FIG. 5;

DETAILED DESCRIPTION OF PREFERRED EMBODIMENTS

Figure 1:
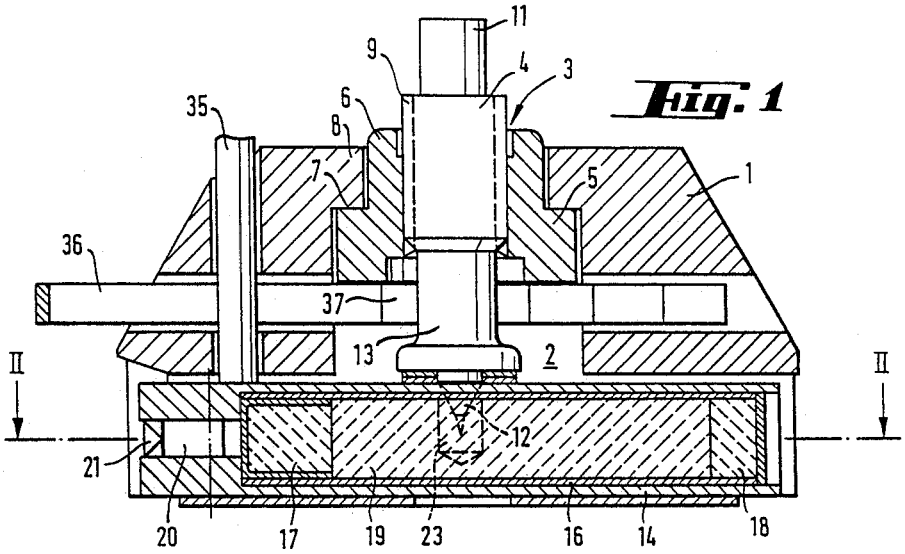
FIG. 1 is an axial section through a fuse according to the invention in the unarmed state.

The fuse for a cargo warhead grenade according to the invention shown in FIGS. 1 to 8 comprises a housing 1 having a chamber 2 holding a striker assembly 3. Striker assembly 3 comprises a shaft 4 located within the axial bore of a collar 5 having a neck portion 6 and a shoulder 7 adapted for cooperation with an overhanging rim portion 8 of housing 1 in the manner shown in FIGS. 1, 4, 7 and 8. In the unarmed position shaft 4 is screwingly held within collar 5 by means of a screw-threaded portion 9 of the shaft engaging a screw-threaded portion 10 (see FIGS. 4 and 7) of the axial bore of collar 5.

Figure 4:
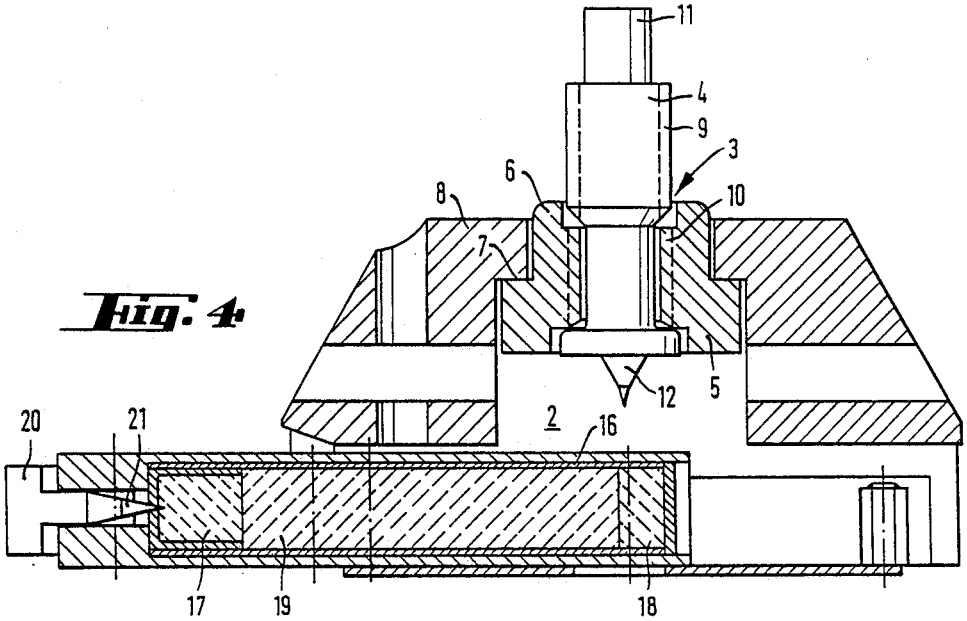
FIG. 4 is an axial section of the fuse of FIG. 1 in the armed position.

Shaft 4 of the striker assembly 3 can be unscrewed and thereby move axially from the forward position shown in FIG. 1 into the retracted, armed position shown in FIG. 4. The armed position of FIG. 4 is brought about by the action of the drag producing means such as a drag tape (not shown) that is connected in a manner known per se to the tail portion 11 of shaft 4 and which, due to the spin of the entire cargo warhead grenade, causes shaft 4 to revolve relative to collar 5. The front end of shaft 4 is fitted with a striker pin 12 and the shaft further comprises a neck portion 13 flanked by two portions of larger diameter.

Housing 1 also accommodates a slider 14 holding a detonator 15. Slider 14 further comprises a delayed action ignition device 16 extending in radial direction and comprising an igniter charge 17, a booster charge 18 spaced therefrom and located in close proximity to detonator 15, and interposed between them a pyrotechnic delay charge 19. Associated with igniter charge 17 is a swingable striker 20 having a striker tooth 21 and being mounted on slider 14 by means of a pivot 22.

A socket 23 in slider 14 is adapted for engagement by striker pin 12 in the forward, locked position shown in FIG. 1.

A spring-loaded locking pin 24 is housed in a cylindrical cavity of slider 14 and is adapted to snap into a shoulder 25 in the body of the grenade when in register therewith in consequence of the extraction of slider 14 into the forward, armed position (see FIGS. 3 and 6) the arrangement serving for securing the slider in the armed position.

Within a radial bore 26 of housing 1 there is mounted a spring-loaded locking pin 27 whose tip 28 is adapted to engage a suitably dimensioned cylindrical socket 29 in slider 14, the arrangement serving for locking the slider in case of unintentional dislocation in state of rest.

Housing 1 comprises stops 30 and. 31 adapted for cooperation, respectively, with shoulders 32 and 33 of slider 14, thereby to arrest the slider in its extreme forward, armed position.

Interposed between slider 14 and housing 1 and located within a cavity of the latter, is an omega-shaped spring 34 which slightly biases slider 14 out of the retracted position.

For safety in storage the fuse comprises two spatially removed safety pins 35 and 36 extending in spatially intersecting directions. Safety pin 35 engages slider 14 and swingable striker member 20 thereby locking both of them, while safety pin 36 by means of a protrusion 37 bears on the neck portion 13 of shaft 4 thereby limiting its axial dislocation. Prior to loading a cargo warhead grenade fitted with a fuse according to the invention into a cargo projectile, both safety pins 35 and 36 are withdrawn.

Figure 2:
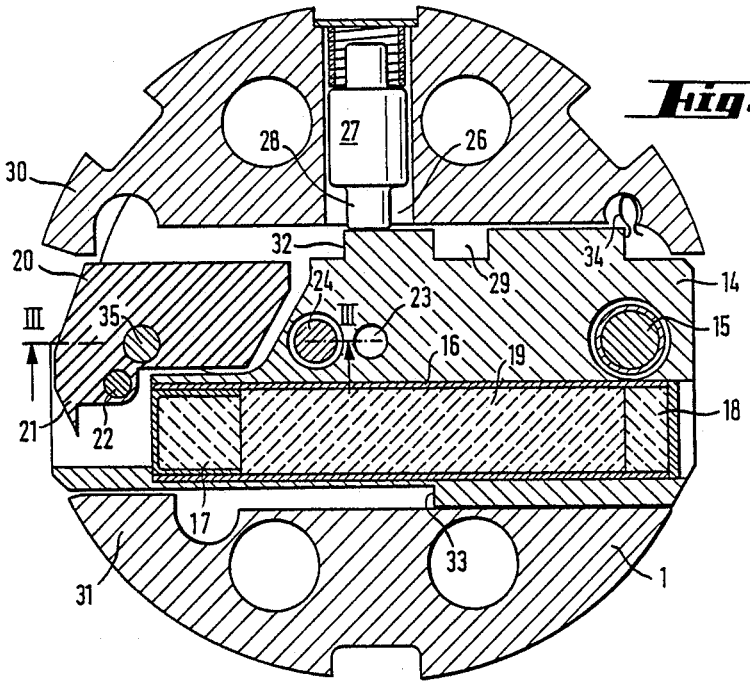
FIG. 2 is a section along the lines II—II of FIG. 1.

The operation of the above described fuse is as follows:

In the unarmed position shown in FIGS. 1 and 2, slider 14 is locked by means of striker pin 12 engaging socket 23, and consequently the slider remains in the retracted position even when safety pins 35 and 36 are withdrawn. When the grenade with the fuse mounted on it is ejected from the cargo projectile, it begins to spin around its longitudinal axis and in consequence of the drag resulting from the drag producing means connected to the tail portion 11 of shaft 4, the latter is unscrewed and thereby withdrawn out of engagement with slider 14 into it's armed position of FIG. 4.

Figure 5:
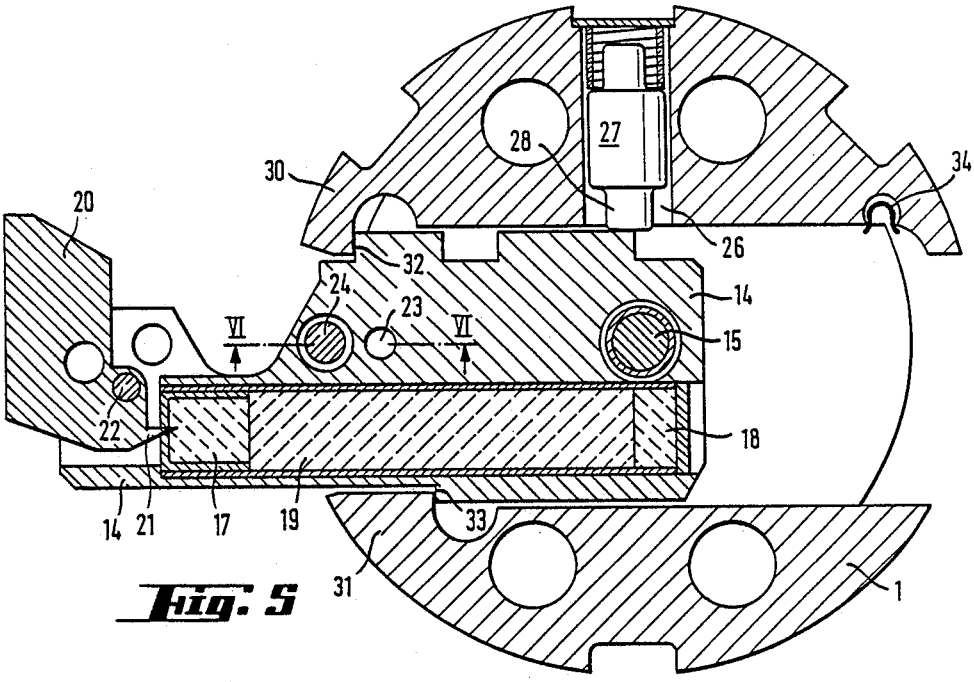
FIG. 5 is a section along lines V—V of FIG. 4.

Once the striker pin 12 is withdrawn, slider 14 becomes free to slide into the forward, armed position of FIG. 4. The first push is imparted to it by means of the omega-shaped spring 34 and once the slider starts moving it continues to move by the action of the centrifugal forces until shoulders 30 and 31 abut stops 32 and 33, respectively, as shown in FIG. 5. In this way slider 14 is arrested in the position in which detonator 15 is aligned with the striker pin 12 and the fuse is armed.

As long as the swingable striking member 20 is within slider 14 it is blocked and cannot freely swing about its pivot 22. However, once the swingable striking member 20 emerges out of housing 1 and is unblocked, it is free to swing by the action of the centrifugal forces resulting from the spin of the grenade. In consequence striker tooth 21 strikes igniter charge 17 as shown in FIGS. 4 and 5 whereby the delayed action igniter charge is ignited and a combustion front progresses gradually along the delay charge 19 towards booster charge 18. The speed of combustion of charge 19 is such that in normal operation the grenade will hit its target before the combustion front reaches booster charge 18.

Figure 7:
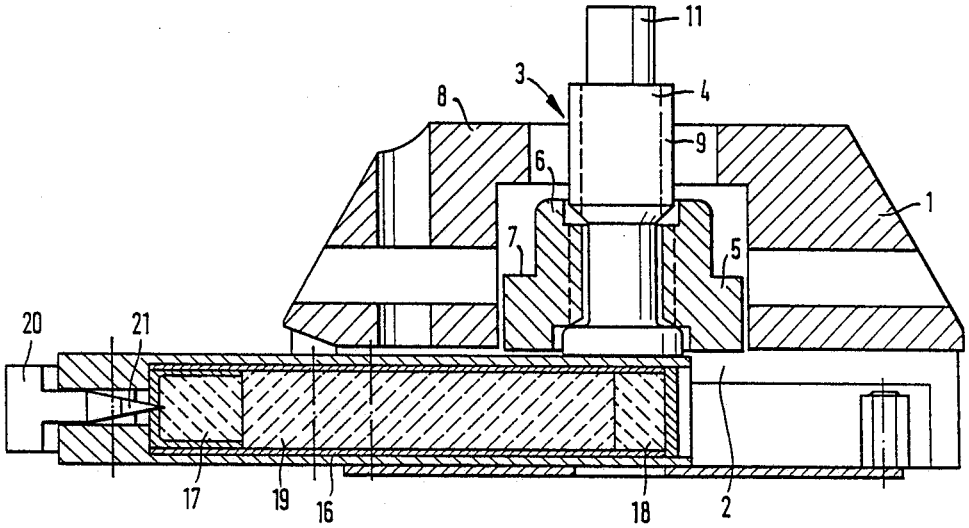
FIG. 7 is an axial section through the fuse of FIGS. 1–6 showing the striker assembly in the striking position.

When the grenade hits a hard target the entire striker assembly 3 moves down axially from the position of FIG. 4 and striker pin 12 strikes detonator 15, as shown in FIG. 7, whereby the main charge of the grenade is caused to explode. If, however, the grenade hits a soft target such as snow or marshy soil, or if the striker assembly 3 is blocked, striker pin 12 will not strike detonator 15 in consequence of the landing of the grenade. In such an event the combustion inside the pyrotechnic delay charge 19 continued to progress until booster charge 18 is ignited and due to the close proximity of booster charge 18 to detonator 15 the latter is ignited by the booster charge whereby the grenade will explode.

Figure 8:
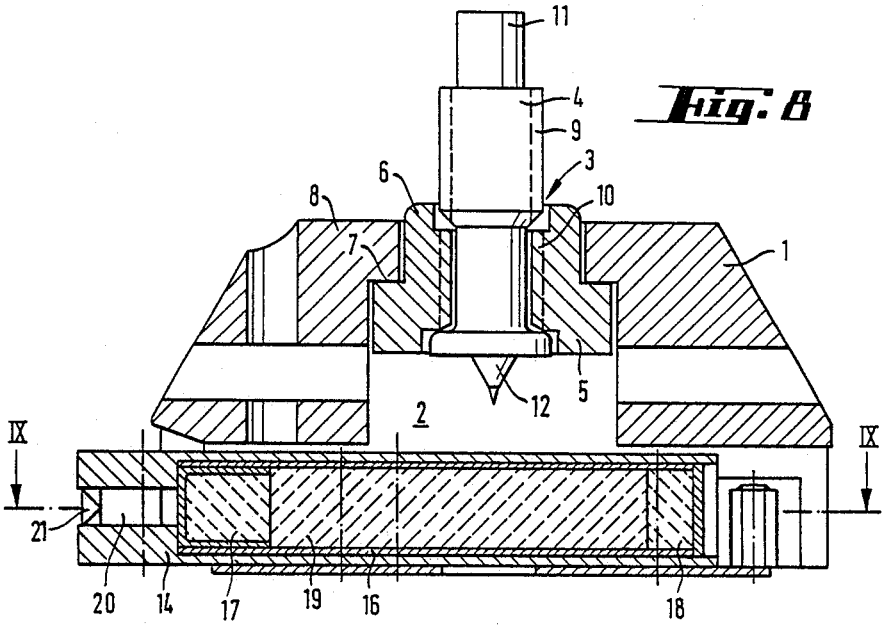
FIG. 8 is an axial section through the fuse of FIG. 1 showing the slider in slight radial dislocation.
Figure 9:
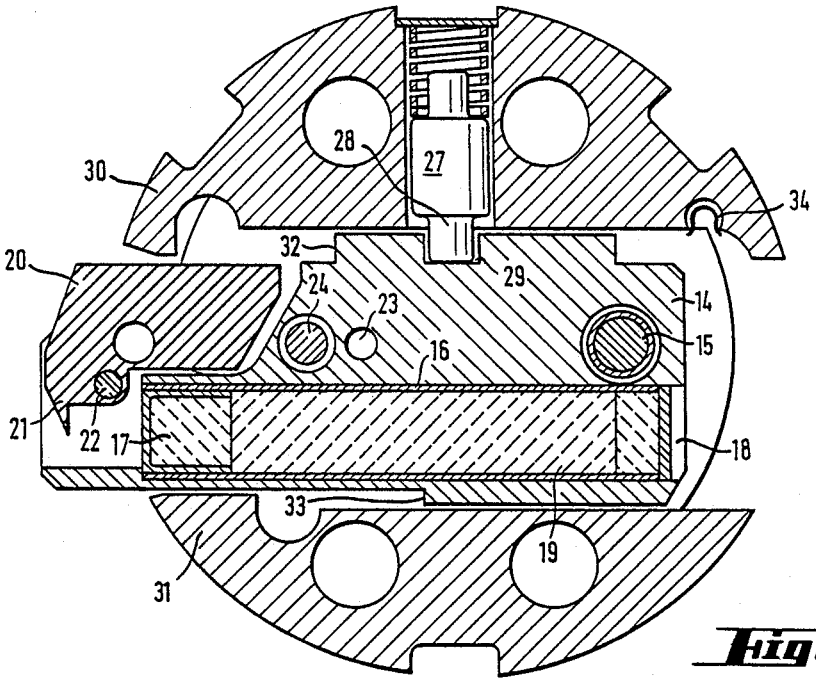
FIG. 9 is a section along lines IX—IX of FIG. 8.

The spring of locking pin 27 is so designed that the bias on locking pin 27 is smaller than the centrifugal force acting on the pin in opposite direction in consequence of the spin of the grenade during its flight. As a result, the locking pin 27 remains withdrawn within cavity 26 and does not interfere with the movement of slider 14 from the retracted position of FIGS. 1 and 2 into the forward, armed position of FIGS. 4 and 5. Where, however in consequence of some handling shaft 4 is inadvertently unscrewed out of engagement with slider 14 in a state of rest of the grenade but with safety pins 33 and 34 removed, and slider 14 is caused to slide out of its retracted position, tip 28 of locking pin 27 snaps into recess 26 by the biasing action of the spring as soon as the recess registers with the locking pin, whereby slider 14 is locked again and prevented from moving any further. This position is shown in FIGS. 8 and 9.

In normal operation when slider 14 reaches its extreme forward position shown in FIGS. 4 and 5, pin 24 snaps into shoulder 25 as shown in FIG. 6 whereby any return movement of the slider is prevented.

Figure 10:
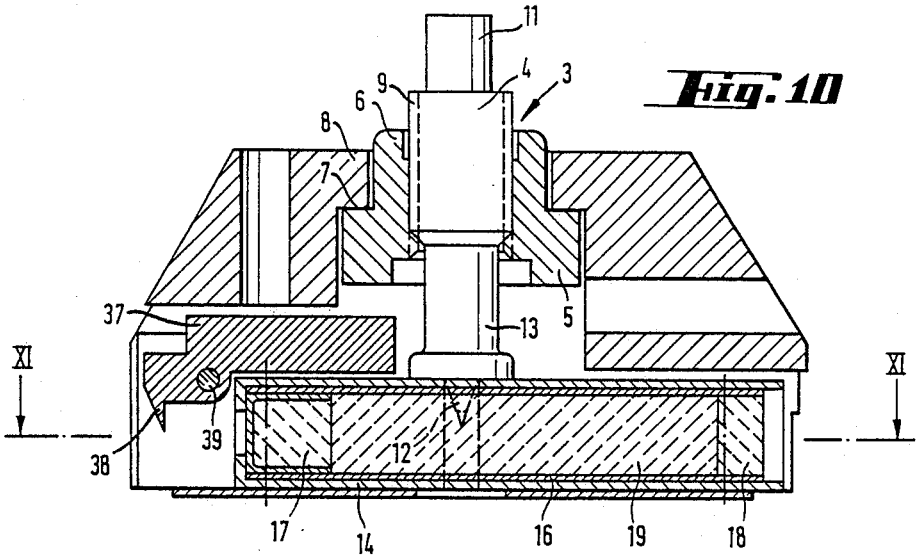
FIG. 10 is axial section through another embodiment of a fuse according to the invention.
Figure 11:
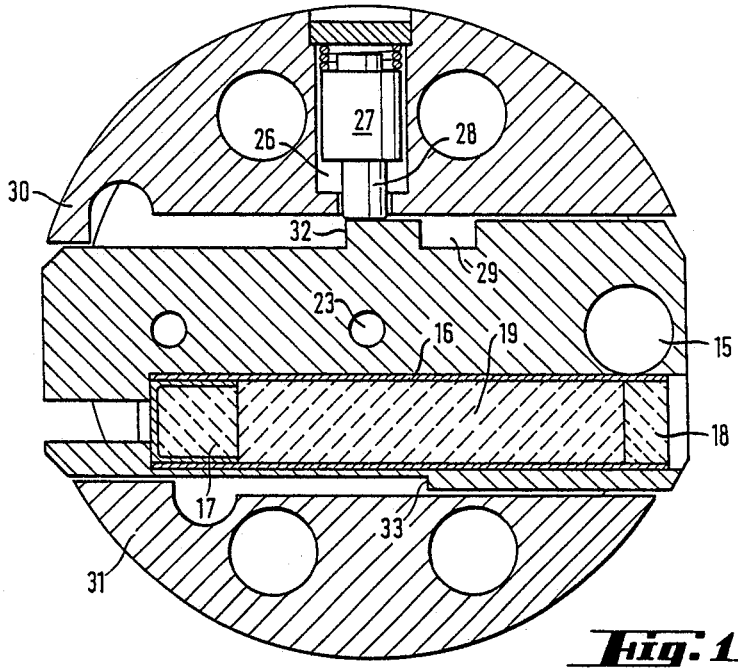
FIG. 11 is a section along lines XI—XI of FIG. 10.

In the embodiment of the fuse according to the invention shown in FIGS. 1 to 9, the swingable striker member 20 is designed to swing in a horizontal plane. Such an arrangement is, however, not critical and the swingable striker member may be mounted so as to swing in any other plane, e.g. in a vertical plane. Such an arrangement is shown in FIGS. 10 and 11 in which a swingable striker member 37 having a striker tooth 38 is mounted on a horizontal pivot 39 and is thus designed to swing in a vertical plane. Similar as in the embodiment of FIGS. 1 to 9, once the swingable striker member 36 emerges out of the housing and is thereby unblocked, it swings by the action of the centrifugal forces whereby striker tooth 37 strikes the igniter charge of the delayed action ignition means. For the rest, the embodiment of a fuse according to the invention shown in FIGS. 10 and 11 is analogous to that of FIGS. 1 to 9 and need therefore not be described in detail. Similar parts are designated in FIGS. 10 and 11 by the same numerals as in FIGS. 1 to 9.

We claim:

1. A slider type fuse for a cargo warhead grenade comprising a housing adapted for mounting on said grenade and accommodating a striker pin assembly having a collar and a shaft screwingly mounted therein, which shaft has an inner end portion fitted with a striker pin and an outer tail portion adapted to carry drag producing means and is capable of being unscrewed and thereby to move within said collar in axial direction from a forward, locking to a retracted, armed position, the housing further accommodating a slider holding detonator means adapted for impact ignition by said striker pin, which slider is moveable radially from a retracted position in which said detonator means are out of alignment with said striker pin to a forward position in which said detonator means are in alignment with said striker pin, said slider being locked in the retracted position by said striker pin and being unlocked when said striker pin is retracted, the improvement by which said slider is moveable from the retracted to the forward, armed position by centrifugal forces resulting from the spin of the cargo warhead grenade; and further characterised by delayed action ignition means accommodated within said slider and comprising an igniter charge, a booster charge removed therefrom and located in close proximity to said detonator means and a delay charge located between the two, and swingable striker means associated with said igniter charge swingably mounted on the slider near an end thereof which projects out of said housing when the slider is in the forward, armed position, which swingable striker means are blocked in the retracted position and are unlocked in the forward, armed position of the slider and are capable of swinging by the action of centrifugal forces resulting from the spin of the cargo warhead grenade thereby to strike said igniter charge.

2. A fuse according to claim 1, comprising spring means which bias the slider out of the retracted position and are adapted to initiate the radial dislocation thereof.

3. A fuse according to claim 1, comprising locking means adapted to arrest any radial dislocation of the slider in a state of rest.

4. A fuse according to claim 3, wherein said locking means comprise a spring-loaded locking member located in the housing and a recess in the slider for engagement by said locking means when the two register, said spring being so designed that during normal flight the centrifugal forces resulting from the spin of the grenade retain the locking member out of engagement with the slider.

5. A fuse according to claim 1, comprising locking means for arresting said slider in the forward, armed position.

6. A fuse according to claim 5, wherein said locking means comprise a spring-biased locking pin located in the slider and a matching recess located in the body of the grenade at such a location that the recess registers with the pin in the forward, armed position of the slider.

* * * * *